US007647715B2

(12) United States Patent
Caravacci et al.

(10) Patent No.: US 7,647,715 B2
(45) Date of Patent: Jan. 19, 2010

(54) IMAGE-HOLDER ARTICLE USABLE AS POSTCARD

(75) Inventors: Guido Caravacci, Rome (IT); Paola Sorgini, Rome (IT)

(73) Assignee: Ink on the Sky Di Paola Sorgini, Rome (IT)

( * ) Notice: Subject to any disclaimer, the term of this patent is extended or adjusted under 35 U.S.C. 154(b) by 387 days.

(21) Appl. No.: 10/543,742

(22) PCT Filed: Mar. 7, 2003

(86) PCT No.: PCT/IT03/00138

§ 371 (c)(1),
(2), (4) Date: Jul. 29, 2005

(87) PCT Pub. No.: WO2004/078484

PCT Pub. Date: Sep. 16, 2004

(65) Prior Publication Data

US 2006/0156593 A1 Jul. 20, 2006

(51) Int. Cl.
*G09F 1/00* (2006.01)

(52) U.S. Cl. ..... 40/124.06; 40/124.07; 40/738

(58) Field of Classification Search ..... 40/124.06, 40/124.07, 761, 777, 778, 738, 737, 798, 40/754, 606.12

See application file for complete search history.

(56) References Cited

U.S. PATENT DOCUMENTS

| | | | | | |
|---|---|---|---|---|---|
| 945,710 | A | * | 1/1910 | Doxsee | 229/92 |
| 956,916 | A | * | 5/1910 | Wiederseim, Jr. | 40/124.06 |
| 1,555,566 | A | * | 9/1925 | Furste | 40/124.06 |
| 2,160,724 | A | * | 5/1939 | Fletcher | 40/603 |
| 2,637,924 | A | * | 5/1953 | Hutt | 40/124.06 |
| 2,842,882 | A | * | 7/1958 | Greene et al. | 40/710 |
| 2,862,322 | A | * | 12/1958 | Ziegler | 40/738 |
| 2,873,545 | A | * | 2/1959 | Noel | 40/738 |
| 3,664,049 | A | * | 5/1972 | Smith | 40/800 |
| 4,001,853 | A | * | 1/1977 | Seagel | 396/651 |
| 4,048,740 | A | * | 9/1977 | Zitzelberger et al. | 40/778 |
| 4,890,402 | A | * | 1/1990 | Carroll | 40/124.06 |
| 4,934,078 | A | * | 6/1990 | Sloot | 40/754 |
| 5,822,896 | A | * | 10/1998 | Milstein | 40/124.07 |
| D406,699 | S | * | 3/1999 | Mullen | D6/300 |

(Continued)

*Primary Examiner*—William L. Miller
(74) *Attorney, Agent, or Firm*—Ferdinand M. Romano, Esq.; Beusse, Wolter, Sanks, Mora & Maire, P.A.

(57) ABSTRACT

An image-holder article usable as postcard, that can be sent by mail but that can also be used to display the image incorporated therein, and mailable in standard ways is effectively usable as postcard, allows display of the image on a surface that remains flat, comprising: a first flat sheet-like support (2), with an image being reproduced thereon, comprising side flaps (3) delimited by the edge thereof and by fold lines (5), so that said flaps are foldable and may adopt a folded configuration with respect to the first sheet-like support and an extended configuration, forming an uniform plane with the first sheet-like support; a second flat sheet-like support (6) made of a substantially flexible material, so as to be reversibly flexed assuming a cambered position, and having an extension such that, if inserted between said flaps (3) in a folded configuration with its edges resting on said fold lines, it adopts said cambered position and determines, in cooperation with said first sheet-like support (2), a resting base allowing the display of said image.

13 Claims, 4 Drawing Sheets

U.S. PATENT DOCUMENTS 6,216,378 B1 * 4/2001 Roberto ..... 40/773
6,293,038 B1 * 9/2001 Chang ..... 40/738
7,100,317 B1 * 9/2006 Strong ..... 40/124.07
7,117,621 B2 * 10/2006 Chang ..... 40/738
2003/0196365 A1 * 10/2003 Bracker et al. ..... 40/738

* cited by examiner

IMAGE-HOLDER ARTICLE USABLE AS POSTCARD

BACKGROUND OF THE INVENTION

1. Field of the Invention

The present invention relates to an image-holder article usable as postcard, as well as to display the image incorporated therein, and mailable in standard ways.

2. Description of the Related Art

Generally, postcards constitute a highly appreciated system for sending wishes and greetings. To postcards, particularly to those sent from tourist resorts, images, e.g. drawings or photos, are associated depicting views, monuments, scenes meant to re-create the atmosphere of the visited site.

Works of art, in particular paintings or photographs, are another subject peculiar to postcards, which may be purchased in order to satisfy artistic interests or for collecting.

Postcards and greetings cards, bearing images related to events object of the greeting, like birthdays, anniversaries, births, graduations etc are also extremely common. Alike postcards are also usable for advertising purposes, as wedding or invitation cards, calendars, menus, etc.

These postcards or cards may be sent by themselves, and in this case they at least the room for the address and a stamp, or in an envelope.

In all cases, postcards, after mailing (which is actually not strictly necessary) become souvenirs. Received or anyhow purchased postcards are commonly displayed because of the artistic or landscape value of the images they bear, or as a mere souvenir.

The particular shape of the postcard, e.g. booklet- or wallet-shaped, may facilitate such a display enabling the former to be placed standing in a half-open configuration.

Otherwise, it is known to reproduce images on a dedicated support, associated to the same postcard, intended as postcard and as support for the address and for the text that is transmitted to the recipient.

In this way the image, being reproduced on a support enhancing its qualities, is exploited, and may be inserted in known image-holder devices, such as frames or the like.

Nevertheless, no known example matches image enhancement with ease of display while keeping a structure simple and mailable via standard mailing service.

Moreover, complex systems providing foldable and composite paper items are known. However the complexity thereof makes their circulation at least complicated.

BRIEF DESCRIPTION OF THE INVENTION

The technical problem underlying the present invention lies in providing an image-holder article usable as postcard allowing the overcoming of the drawbacks mentioned with reference to the known art.

This problem is solved by an article as specified above, comprising:

- a first flat sheet-like support, an image being reproduced thereon, comprising side flaps delimited by the edge thereof and by fold lines, so that said flaps can be foldable and may adopt a folded configuration with respect to the first sheet-like support and an extended configuration, forming an uniform plane with the first sheet-like support;
- a second flat sheet-like support in a substantially flexible material, so as to be reversibly flexed assuming a cambered position, and having an extension such that, inserted between said flaps in a folded configuration with its edges resting on said fold lines, adopts said cambered position and determines, in cooperation with said first sheet-like support, a resting base allowing the display of said image.

It is understood that the second support in particular may be the actual postal medium, with the first support associated to the second by any fastening means such as a removable clip or a reversable adhesive. Otherwise, the first and second support may be associated to an envelope containing them.

In both cases the article according to the invention allows an effective use as postcard, as well as the display of the image reproduced on said first support. In fact, the image itself is transferred on a surface that remains flat, whereas the second support is bent and serves as support.

According to preferred embodiments, said first support is rectangular and transparent, making the image seeable-through like a slide. Moreover, also the second support can be rectangular and have an extension slightly larger with respect to the first support, with slots in which the corners of the first support may be inserted with the flaps in an extended configuration, thereby determining a single assembly in the form of a postcard that can be used as such.

Thus, the translucid surface sets off the image to the utmost, whereas the second support may also serve as background. Moreover, the configuration of the second support enables to avoid the use of additional support-associating systems, making the use of an envelope unnecessary.

Hereinafter, the present invention will be described with reference to an embodiment thereof, given by way of a non-limiting example and making reference to the annexed drawings, wherein:

DETAILED DESCRIPTION OF EMBODIMENTS OF THE INVENTION

Figure 1:
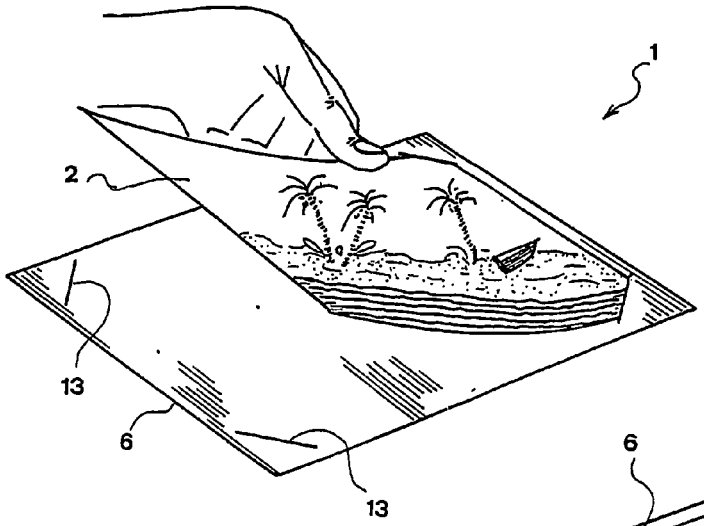
FIG. 1 is a front perspective view of an image-holder article usable as postcard according to the present invention.

With reference to the figures, an image-holder article usable as postcard is generally indicated by 1.

It comprises a first flat sheet-like support 2, printable and advantageously made of a transparent material, e.g. of a polyethylene or a cellulose-base translucid material.

The material and/or the thickness should be such as to make the support firm, flexible yet difficult to fold, naturally apt to adopt a flat shape.

On a face of the first support 2 an image of any kind is reproduced, e.g. a photo, a painting reproduction, a drawing, etc., printed with any technique that suits the support.

Besides printing, it can be provided for the image to be directly drawn on the support by the author, transferred to the support by transfers, stickers, etc.

In particular, the image may be reproduced alternating areas that are colored, transparent or made opaque with coloring with blank areas corresponding to the image background. Otherwise, the image may lack the transparent background and be entirely printed.

In the present embodiment the first support 2 is rectangular and the image is printed on a central portion thereof.

At opposite edges, e.g. on the short edges of the first support 2, side flaps 3 delimited by the respective edge of the first sheet-like support 2 and by fold lines 5, parallel to said edge are formed, so that the shape of the flaps is substantially that of a rectilinear strip, extending across the edges of the first support 2.

This arrangement allows the flaps 3 to be folded and to adopt a folded configuration with respect to the first sheet-like support 2, and an extended configuration, forming a plane uniform with the first sheet-like support 2.

It is understood that the central portion, indicated by 4 and onto which said image is reproduced, is that comprised between said fold lines 5.

As it will be made apparent hereinafter, the flaps 2 may adopt a different configuration; in particular they could be formed at the long edges of the first support 2.

The article 1 further comprises a second flat laminar support 6 made of a substantially flexible material.

The kind of material, e.g. a cardboard, should be such that the second support 6 may be reversibly flexed assuming a cambered position.

Said second support 6 is it also rectangular and has an extension slightly larger than that of the first support, both widthwise and heightwise. In particular, said extension should be such that, with the second support 6 inserted between said flaps 3 of the first support in a folded configuration (FIGS. 6 to 9B), with its edges resting on said fold lines 5, the former adopts said cambered position.

The obtained configuration determines, in cooperation with said first sheet-like support 2, a substantially flat resting base, allowing the display of said image.

Hence, the ease of use of the present article and the potential provision of any image to the public are apparent.

Figure 3:
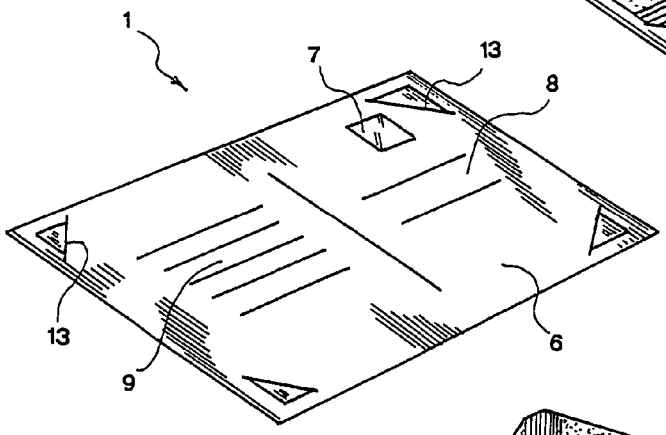
FIG. 3 is a rear perspective view of the article of FIG. 1.
Figure 9A:
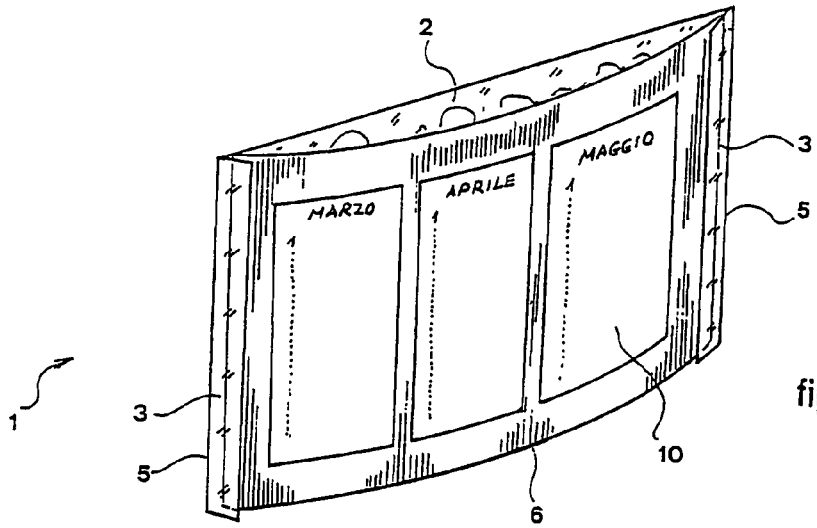
Figure 9B:
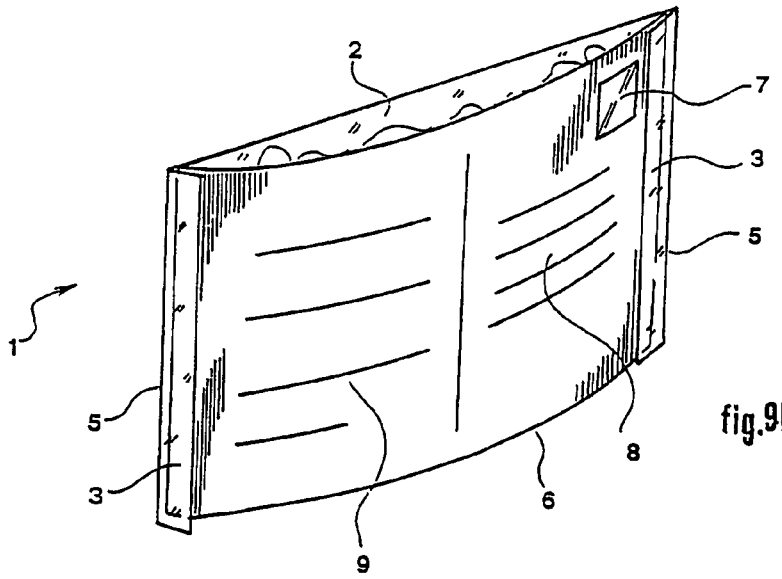

Several alternative uses may be envisaged for the faces of the second support 6. For example, tracings may be plotted thereon for the use thereof as postcard, with the stamp area 7, the address area 8 and the message area 9 (FIGS. 3 and 9B).

Otherwise, said second support 6 may be used to reproduce a calendar 10 (FIG. 9A) displayable onto the convex or even the concave portion, in this case remaining visible through said first transparent support 2.

Figure 8:
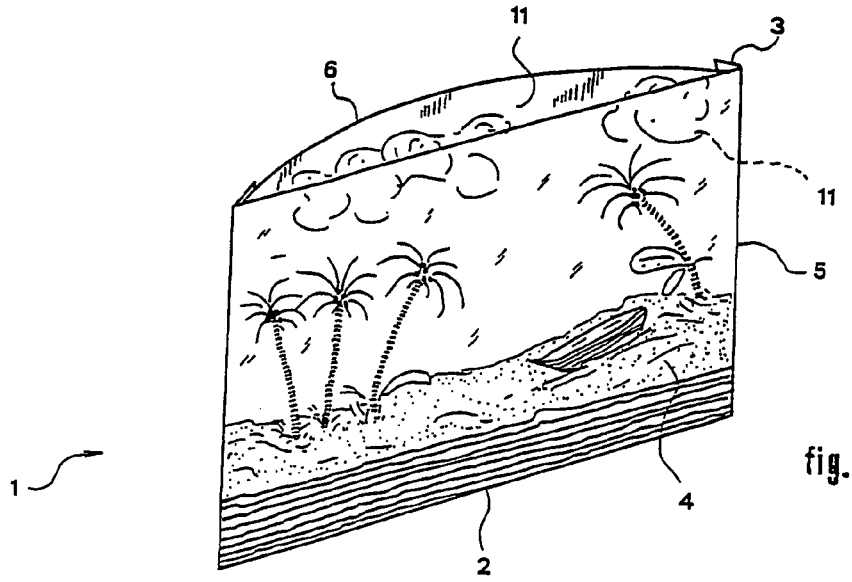
FIGS. 8, 9A and 9B are perspective views illustrating further variants of the article of FIG. 1.

Another example envisages the reproduction of a background 11 for the image reproduced onto the first support 2 (FIG. 8). The interchangeability of the first and second support 2, 6 in these variants allows a remarkable variety of use.

Yet another variant, not depicted as it is evident in the light of the above, provides a calendar to be reproduced onto the first support 2, with an image reproduced onto the second support 6 to be seen against the light.

Further variants provide the appending of well-wishing or traditional sentences or drawings, e.g. Christmas trees, cakes with birthday candles, wedding rings, etc., restaurant menus, event schedules, advertising messages or images, etc.

Figure 7A:
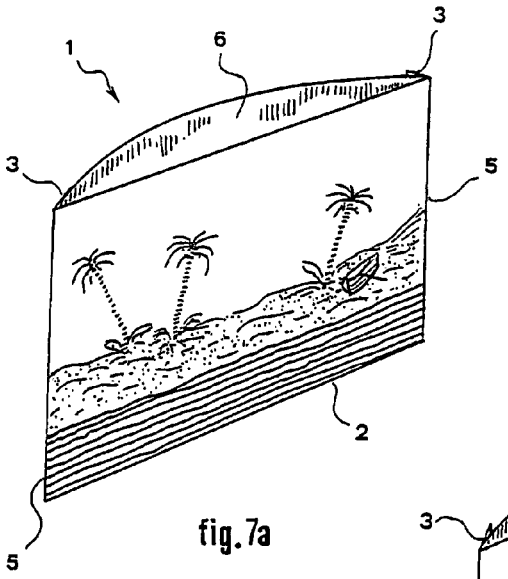
Figure 7B:
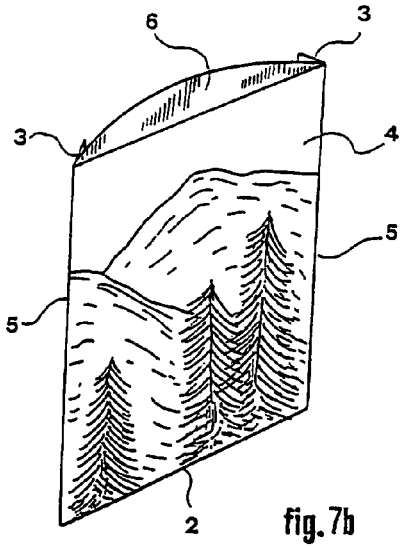
FIG. 7B is a perspective view illustrating an assembly alternative to that illustrated in FIG. 7A.

The flaps 3 may indifferently be located along the short or long sides of the first support 2 (FIG. 7B).

Figure 5:
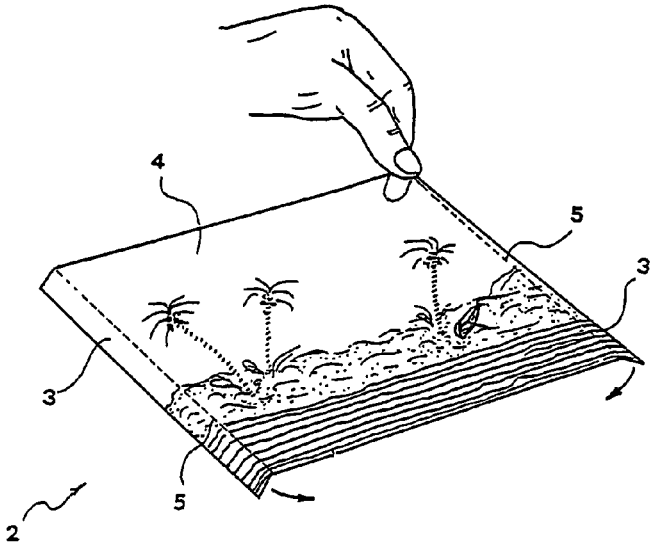
FIGS. 5, 6 and 7A are perspective views illustrating the assembly of the different parts of the article of FIG. 1.
Figure 6:
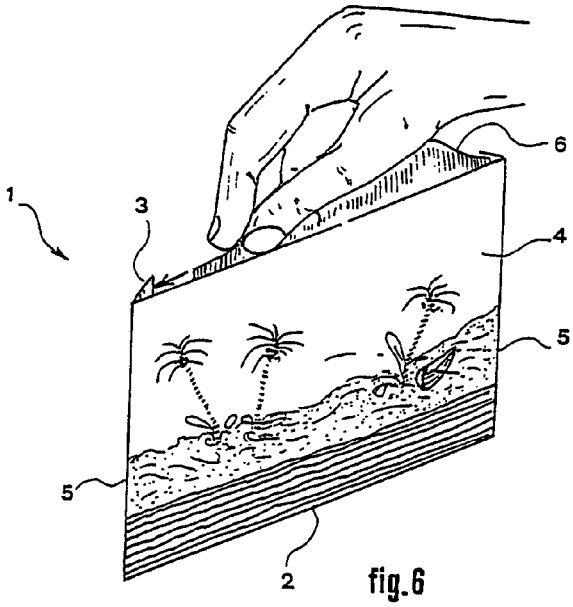

As hereto mentioned, the use of the article is rather simple: it may be marketed in a completely extended shape; subsequently the user may fold the flaps 3 onto the respective fold lines 5 (FIG. 5); insert the second support 6 between the flaps 3 taking care to arrange the edges of the second support 6 internally to the flaps 3, at the corresponding fold line 5 (FIG. 6); then the mutual position of the supports 2, 6 may be adjusted, as the association therebetween allows the sliding thereof; thus, a flat base allowing the display of the article 1 can be made, with the first support 2 standing and on a plane, and with the image satisfactorily displayed and value-enhanced.

The use of the transparent material for the first support 2 attains a particular enhancement of the image and interesting plays of light.

Moreover, in order to attain an additional and interesting effect, the above described assembled article may also be rested onto its cambered surface determined by the second support. Thus, a 'cradle effect' is attained, with the image that may rock when pushed.

Notwithstanding its use being sufficiently intuitive, the article may be marketed along with a short instruction note.

Figure 4:
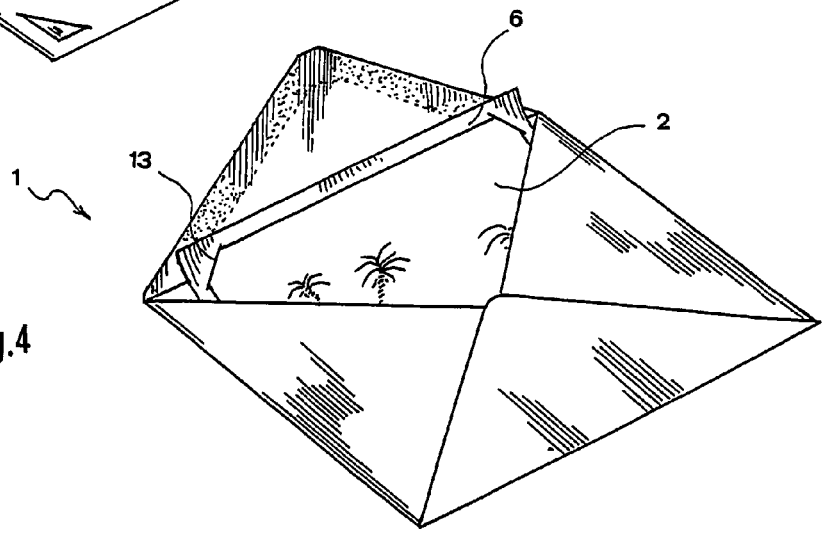
FIG. 4 is a perspective view of the article of FIG. 1 in association with an envelope.

The association between the two supports 2, 6 may take place in various ways: in the simplest configuration there may be employed an envelope 12 (FIG. 4) or another casing, optionally transparent to allow image vision. The same envelope 12 may be used for the mailing and provided separate from the support in a transparent casing, in order for the image to be seen.

Other means for associating the two first supports may consist of one or two tiny clips, a reversable and optionally removable adhesive material, etc.

A particularly advantageous associating means consists of through slots 13, obtained onto the second support 6, the edges and/or the corners of the first support 2 being insertable therein.

Figure 2:
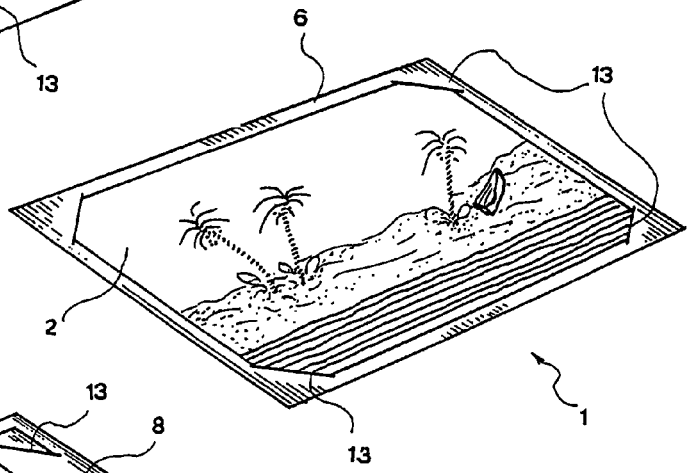
FIG. 2 is a perspective view of the article of FIG. 1 in a different configuration.

Said slots 13 are suitably made oblique at the corners of the second support 6 (FIGS. 2, 3), on all four corners or optionally on two opposite corners.

The slots 13 may easily be obtained, without altering the strength of the second support 6.

Moreover, it is understood that the above described article may be marketed in a set containing more than one first support and/or more than one second support, in order to obtain different configurations, composite images, image combinations, etc. Moreover, it is possible to assemble more than one transparent first support on a second support. In this case, the resulting image will ensue from the overlapping onto the individual images impressed onto the first supports, with the option of obtaining variable composite images (e.g., the same image with various images overlappable thereon to evoke the changing of seasons)

Arranging the assembled article on any display stand enhances the quality of the display. However, a specific display stand, described hereinafter, can fully exploit the features of the article when the latter employs a transparent first support 2.

Figure 10A:
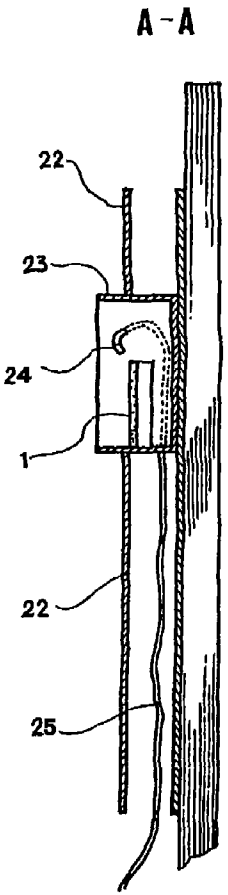
FIG. 10A is a cross section of the display stand of FIG. 10 taken along line A-A.
Figure 10:
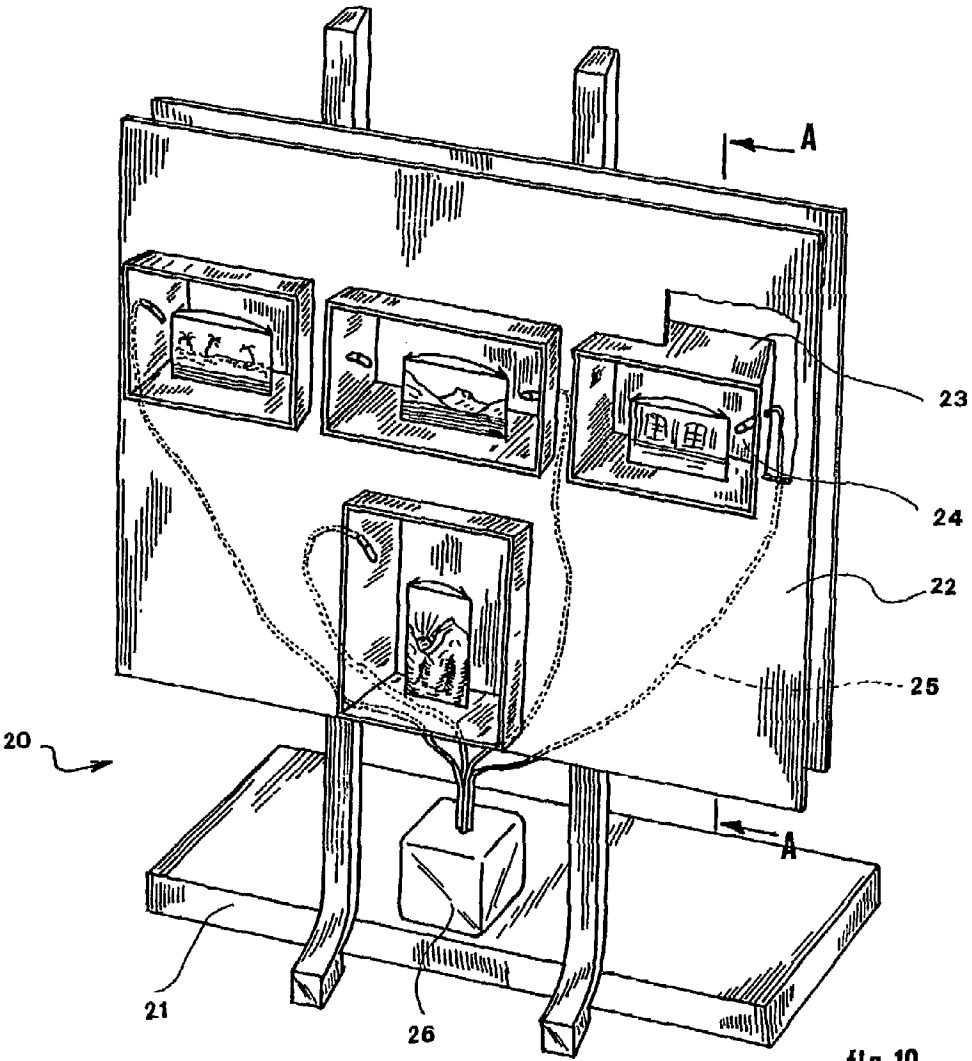
FIG. 10 is a perspective view of a display stand exploiting the peculiarities of the article of FIG. 1.

With reference to FIGS. 10, 10A, a display stand for articles 1 as above described is generally indicated by 20. It comprises a base 21 bearing a flat display stand 22, having a plurality of compartments 23 apt to house one or more articles 1.

Said compartments 23 are of box type, shaped as a parallelepiped from which one side has been removed. Advantageously, the inside of the compartment 23 is of a dark color, preferably opaque and black.

Each compartment comprises at least one light source 24 located near the displayed article 1, so as to backlight the first support 2. Thus, the reproduced image stands out in a bright and colorful manner, in striking contrast with respect to the dark background. Moreover, color reflections are projected in the surrounding space.

The light source 24 may be obtained via a fiber optic filament 25 connected to a suitable generator 26.

With said display stand 20, exploiting the same inventive concept underlying the image-holder article according to the invention, the image display proves particularly effective, specifically in the marketing of the article.

Such display stands are suitable to be used on specific premises, like e.g. museum shops, since they reproduce the display cases usually containing the exhibited objects on a small scale.

In the light of the above, it is understood that a person skilled in the art may apply numberless structural variants falling within the protective scope defined by the following claims.

What is claimed is:

1. An image-holder article usable as postcard, that can be sent by mail but that can also be used to display a reproduced image incorporated therein, and mailable in standard ways, comprising:

a first flat sheet support made of a transparent material with the image being reproduced in a transparent region for viewing, and with two opposing edge portions of the first support including lines formed thereon and suitable for use as fold lines along which the first support is foldable to form two opposing side flaps each side flap delimited by a respective side edge of the first support and by one of the fold lines, so that said flaps are foldable to adopt either a folded configuration with respect to an initial flat orientation of the first sheet support or an extended configuration, forming a uniform plane with respect to the folded configuration of the first sheet support; and a second flat sheet support formed of a substantially flexible material, enabling it to be flexed away from said first support to assume a cambered position instead of a flat configuration, and having a longitudinal dimension such that, when said flaps are folded and the second flat sheet support is inserted between said flaps with its edges resting along said fold lines, the second flat sheet support adopts said cambered position and provides, in cooperation with said first sheet support, a support base allowing the display of said image for viewing in front of the second flat sheet support.

2. The article according to claim 1, wherein the transparent material of said first flat sheet support is made of a firm, flexible yet hard to fold, material naturally apt to adopt a flat shape.

3. The article according to claim 2, wherein said first support is rectangular and the image is printed on a central portion thereof.

4. The article according to claim 3, wherein said side flaps are delimited by said fold lines, parallel to the edge of the first support, so that the shape of the flaps is substantially that of a rectilinear strip, said central portion being that comprised between said fold lines.

5. The article according to claim 2, wherein said second support is rectangular and the longitudinal dimension thereof is slightly larger than a corresponding longitudinal dimension of the first support.

6. The article according to claim 5, wherein on said second support for the use as postcard are plotted tracings.

7. The article according to claim 5, wherein on said second support a calendar is reproduced.

8. The article according to claim 5, wherein on said second support a background is reproduced for viewing in conjunction with viewing of the image reproduced onto the first support.

9. The article according to claim 1, comprising means for associating said first support and second support.

10. The article according to claim 9, wherein said associating means comprises an envelope.

11. The article according to claim 9, wherein said associating means comprises through slots obtained onto the second support, the corners of the first support being insertable therein.

12. The article according to claim 11 wherein said slots are made oblique at the corners of the second support.

13. The article according to claim 1, comprising a plurality of said first supports.

* * * * *